United States Patent [19]

McGaffin

[11] 4,049,314

[45] Sept. 20, 1977

[54] MULTI-USE FURNITURE

[76] Inventor: Andrew W. McGaffin, 282 Western Hut Road, Belmont, Lower Hut, Wellington, New Zealand

[21] Appl. No.: 669,851

[22] Filed: Mar. 24, 1976

[51] Int. Cl.[2] ..... A47C 13/00

[52] U.S. Cl. ..... 297/130; 297/272; 297/441

[58] Field of Search ..... 297/130, 440, 441, 1, 297/2, 3, 4, 118, 272, 445, 443, 463; 5/127

[56] References Cited

U.S. PATENT DOCUMENTS

| | | | |
|---|---|---|---|
| 2,209,145 | 7/1940 | Weber | 297/440 |
| 2,305,249 | 12/1942 | Frost | 297/441 X |
| 2,713,890 | 7/1955 | Mack | 297/441 UX |
| 3,121,587 | 2/1964 | Bavaro | 297/1 |

FOREIGN PATENT DOCUMENTS

| | | | |
|---|---|---|---|
| 1,264,585 | 5/1961 | France | 297/1 |
| 58,756 | 11/1953 | France | 297/441 |
| 1,288,461 | 9/1972 | United Kingdom | 297/441 |

*Primary Examiner*—James T. McCall
*Attorney, Agent, or Firm*—Pasquale A. Razzano

[57] ABSTRACT

A convertible piece of furniture includes four frame elements each of which has a generally right triangularly shaped configuration including a long base, a short leg, and a hypotenuse leg. A connector element is provided for securing the frame members together in generally aligned pairs, with the aligned pairs being located in spaced parallel relation to each other. A flexible sling is adapted to be secured between the spaced aligned pairs of frame members for supporting a person seated on the piece of furniture. The frame elements can be connected in a variety of relative positions in order to form different types of furniture pieces.

11 Claims, 9 Drawing Figures

MULTI-USE FURNITURE

The present invention relates to a furniture piece, and more particularly to a collapsible and/or convertible piece of furniture which is adapted to be assembled in a variety of types of furniture pieces.

There is a substantial demand for inexpensive lightweight furniture that can be used either in the home or out of doors. While numerous types of lightweight lawn furniture have been previously proposed, they are usually limited to chair or lounge types. However when more than one type of seating configuration is required, then more than one piece of furniture is necessary, or, if the piece of furniture is convertible, it usually includes a relatively complex conversion mechanism.

With the present invention a relatively simple convertible furniture piece is provided which consists of four frame elements that can be connected in a variety of configurations in order to form a cot, a chair, or a rocker type hammock. The furniture is constructed of relatively lightweight tubular material and is readily assembled, disassembled, and transported.

It is an object of the present invention to provide an article of furniture which is convertible from a cot, to a chair, to a rocker hammock.

Another object of the present invention is to provide a convertible furniture piece which is relatively lightweight in construction and durable in use.

A further object of the present invention is to provide a convertible piece of furniture which is inexpensive in manufacture and durable in construction.

A still further object of the present invention is to provide a lightweight convertible piece of furniture which is relatively easy to transport and assemble.

In accordance with an aspect of the present invention the convertible piece of furniture includes four frame elements each of which consists of a one-piece tubular element having a pair of free end portions which is bent into the general shape of a right triangle having a long base, a short leg, located at right angles with respect to the long base, and a hypotenuse. The ends of the tube are located adjacent each other at the apex between the hypotenuse leg and the long base. These ends are adapted to be interconnected by a cooperating connecting bar element which can selectively secure the frame elements together in generally aligned pairs located in spaced relation with each other, with either the free ends of the long base of the frame elements in each pair secured to each other, or the free ends of the hypotenuse leg of the frame elements in each pair secured to each other.

With the long bases secured to each other the furniture piece forms a cot; and with the hypotenuse portion secured together the furniture piece forms a rocker type hammock. In addition connector means are provided on the short legs of each of the frame elements for selective cooperation with the connector bar in order to allow the frame elements to be connected together in a chair configuration.

A flexible sling is secured to the frame elements in order to provide the support surface for a person seated or reclining on the piece of furniture.

The above, and other objects, features and advantages of the invention will be apparent from the following detailed description of an illustrative embodiment thereof which is to be read in connection with the accompanying drawings, wherein.

Figure 1:
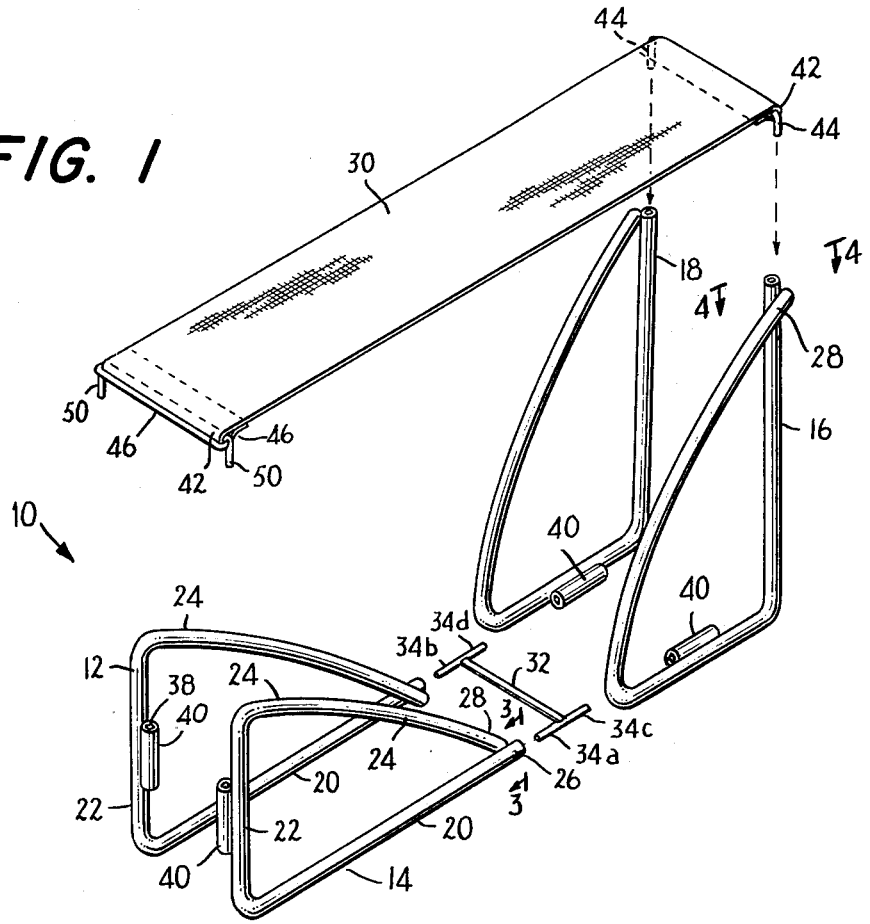
FIG. 1 is an exploded perspective view of the convertible furniture piece of the present invention arranged to form a chair.
Figure 2:
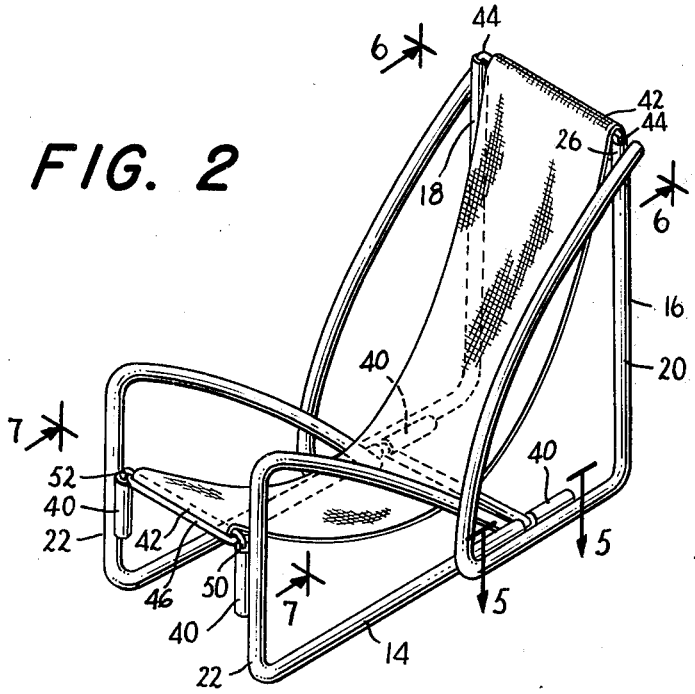
FIG. 2 is a perspective view of the elements of the invention assembled in the chair configuration.
Figure 8:
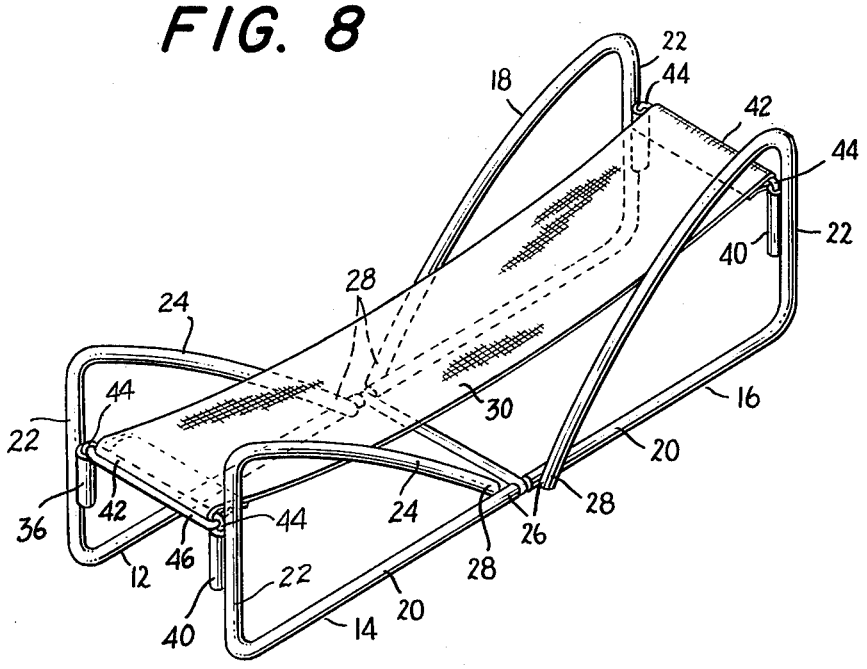
FIG. 8 is a perspective view of the elements of the present invention assembled to form a cot.
Figure 9:
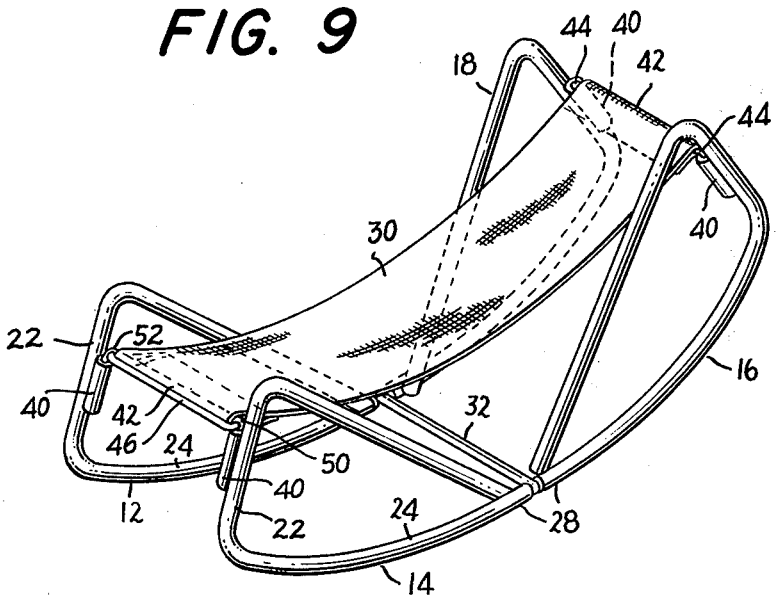
FIG. 9 is a perspective view of the elements of the invention assembled to form a rocker.

Referring now to the drawing in detail, and initially to FIG. 1 thereof, it will be seen that the convertible piece of furniture 10, constructed in accordance with the present invention, includes four generally triangularly shaped frame elements 12, 14, 16, and 18, each of which includes a long base 20, a short leg 22 (which is located at generally a right angle with respect to the base 20) and a hypotenuse leg 24 which extends between the short leg 22 and the end of the base 20. Preferably the frame elements are formed of a one-piece tubular construction with the free end 26 of the long base 20 and the free end 28 of the hypotenuse 24 located adjacent each other at the apex between those sides of the right triangle. These four frame elements are adapted to be connected to each other and to a sling element 30 in order to form a chair, as illustrated in FIG. 2; a cot, as illustrated in FIG. 8; or a rocker type hammock, as shown in FIG. 9.

A generally H-shaped connector bar 32 is used to connect the frame elements together and to hold them in aligned pairs which are spaced laterally from each other by the length of the bar 32. As seen in FIG. 1 bar 32 has four perpendicularly extending legs 34 integrally formed or connected thereto. The legs 34 are adapted to be inserted into the open hollow ends of the long base 20 and the hypotenuse leg 24. Preferably the hollow ends of the tubes have rubber inserts 36 secured therein, as for example by a friction fit or the like, and the inserts having polygonal bores 38 formed therein. The legs 34 have a cross sectional configuration which is complementary to the bores 38 so as to be received in the bores and hold the frame elements against rotation with respect to the connector element 32.

Each of the frame elements is also provided with a connector sleeve 40 secured on the short leg 22 thereof. The sleeve is secured to leg 22 in any convenient manner and is preferably located on one side of the triangle formed by the frame element. As the frame elements and sleeves 40 are preferably formed of aluminum, to provide for light weight and ease in transportation, the sleeves can be secured to the frames by welding, brazing or by metal tap screws or the like. In any event sleeves 40 are also preferably provided with inserts 36 having bores 38 therein which are complementary to the bores 38 in the sleeves positioned in the open ends 26, 28 of the frame elements.

Figure 3:
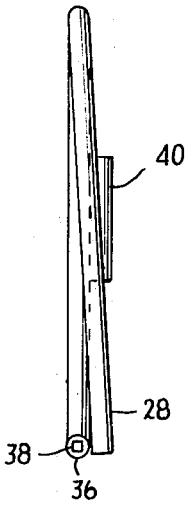
FIG. 3 is an end view of one of the frame elements of the invention taken along line 3—3 of FIG. 1.
Figure 4:
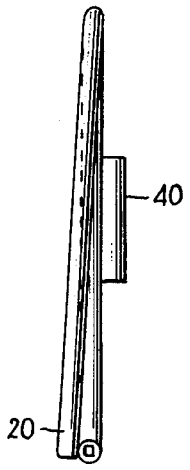
FIG. 4 is an end view of another of the frame elements taken along line 4—4 of FIG. 1.
Figure 5:
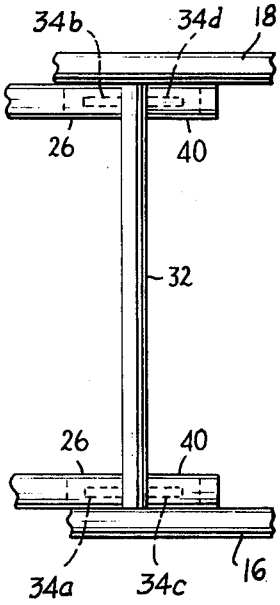
FIG. 5 is a plan view taken along line 5—5 of FIG. 2.
Figure 6:
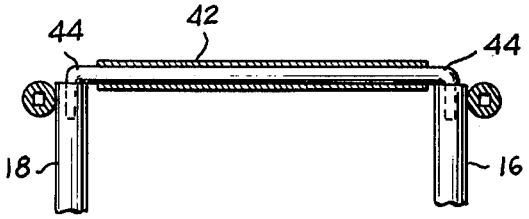
FIG. 6 is a sectional view taken along line 6—6 of FIG. 2.
Figure 7:
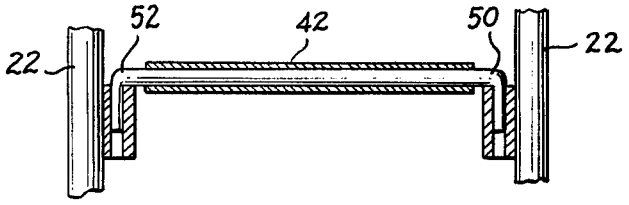
FIG. 7 is a sectional view taken along line 7—7 of FIG. 2.

The frame elements are provided in two pairs, i.e. the pair 12, 14 and the pair 16, 18. These pairs are of essentially the same size, but the ends 28 of their hypotenuse legs are located in different positions with respect to their associated sleeves 40. That is, as seen in FIGS. 1 and 3, the ends 28 of the hypotenuse legs 24 of frame elements 12, 14 are located on the same side of the frame element as their associated sleeve 40. On the other hand, the ends 28 of the hypotenuse legs of the frame elements 16, 18 are located on the side of the frame elements opposite to their associated sleeve elements 40. This difference permits the elements to be connected into the different furniture shapes, described hereinafter.

The final element of the furniture piece of the present invention is the sling 30 which forms the supporting surface for the person seated or reposing thereon. The sling consists of a flexible fabric material such as canvas or the like and has, at its ends, generally U-shaped connector bars 42 secured thereto. One of the bars 42 (at the right in FIG. 1) preferably consists of a single transverse base member and a pair of legs 44 extending perpendicularly therefrom. The other bar 42 consists of a pair of spaced horizontally extending base members 46 between which the end 48 of the canvas sling is wrapped. A pair of depending legs 50 extend therefrom to complete the U-shaped frame. The provision of the double bars 46 facilitates rolling the sling to shorten, or into a compact cylinder when the furniture piece is to be disassembled and transported. Preferably the legs 44, 50 of the frame elements 42 have a polygonal shape which is complementary to the bore 48 of the insert elements 36 in the frame ends and sleeves 40.

In order to assemble the furniture piece of the present invention into a chair shape, as illustrated in FIG. 2, two legs 34*a,* 34*b* of the connector bar 32 are first inserted in the free ends of the long bases 20 of frame elements 12, 14. The other pair of legs 34*c,* 34*d* of bar 32 are then inserted in the sleeves 40 of frame elements 16, 18. Thus the frame elements will be assembled into the configuration illustrated in FIG. 2. The sling 30 is then attached to the frame by inserting the legs 44 of the single bar connector element 42 into the free ends 26 of the long bases 20 in frame elements 16, 18. The legs 50 of the double cross bar connector element 42 are then inserted in the sleeves 40 on the short legs 22 of frame elements 12, 14.

It is noted that because of the location of the free ends of the hypotenuse legs in the two pairs of frame members, as described above, in this configuration of the furniture piece the free ends 26 of bases 20 in frame elements 16, 18, will be generally in alignment (i.e. in substantially the same plane) with sleeves 40 of frame elements 12, 14 so that sling 30 is readily secured therein. However, it also is noted that since the frame elements are preferably formed of a relatively lightweight aluminum, slight twisting of the frame elements is permitted if any misalignment should inadvertently occur.

In order to convert the chair shown in FIG. 2 into the cot of FIG. 8, the chair is disassembled by removing connector bar 32 from sleeves 40 of frame members 16, 18 and the single bar connector element 42 is removed from the ends 26 of the same frame elements. Frame elements 16, 18, are then repositioned so that the ends 26 of their long bases 20 are located in general alignment with the ends 26 of the long bases 20 of frame elements 12, 14. The legs 34*c,* 34*d* of connector bar 32 are then re-inserted in the ends 26 of the long bases 20 of frame members 16, 18, as seen in FIG. 8, and the legs 44 of the single cross bar connector 42 are inserted in sleeves 40 on short legs 44 of frame elements 16, 18. In this configuration, it is noted that because of the difference in the bending of the frame members 12, 14 as compared to the frame members 16, 18 the ends 28 of the hypotenuse legs of frame elements 16, 18 are located on the outside of the frame, while the ends 28 of the hypotenuse legs of frame elements 12, 14 are located on the inside of the frame.

In order to convert the furniture piece into a rocker type hammock, as seen in FIG. 9, connector bar 32 is disassembled from the ends of the frame elements. The frame elements are then positioned, as seen in FIG. 9, with the hypotenuse legs 24 of the frame elements inverted to form the base of the furniture piece. The frame elements are positioned so that the ends 28 of their hypotenuse legs are located adjacent to and in alignment with each other, so that the legs 34 of connector bar 32 can be inserted in those ends to connect the frame elements in aligned parallely spaced pairs. Frame elements 16, 18 must be positioned so that their sleeves 40 are located on the inside of the contemplated frame and, when they are arranged in this manner, because of the location of the ends 28 of the hypotenuse legs on the respective frame elements, those ends will naturally align with each other in the proper location. Because the ends of the hypotenuse legs are relatively flat, the legs 34 of the connector bar can be easily inserted therein. In this configuration the ends 26 of the long bases 20 will be located inside of the frame.

With the frame assembled in this manner sling 30 can be readily secured thereto by inserting the legs of the connector bars 42 in sleeves 40. Thus a rocking type hammock is provided.

As will be apparent, the furniture piece of the invention is relatively lightweight and readily assembled or disassembled in the numerous forms. All that is required are six elements, namely the four frame elements, the connector bar 32 and the assembled sling 30. The furniture piece will be relatively inexpensive and simple to manufacture, and will be highly suitable for mass production operations. It can be easily transported to the beach, or anywhere in the outdoors, while on the other hand its appearance is suitable for use indoors if desired.

Although an illustrative embodiment of the present invention has been described herein with reference to the accompanying drawings, it is to be understood that it is not limited to that precise embodiment, but that various changes and modifications may be effected therein by one skilled in the art without departing from the scope or spirit of this invention.

What is claimed is:

1. A convertible piece of furniture including four separate and independent frame elements each of which comprises a generally right triangularly shaped frame member having a long base, a short leg and a hypotenuse leg; means for releasably and selectively securing said frame members together in generally aligned pairs with the pairs located in spaced parallel relation to each other; a flexible sling and means secured to said sling for securing the sling to said spaced parallel pairs of frame elements; said means for releasably and selectively securing said frame members together comprising means for (i) securing the long bases of said frame elements together adjacent their apices with said hypotenuse leg; and (ii) securing the hypotenuse legs together adjacent their apices with said long base.

2. A convertible piece of furniture as defined in claim 1 including means on the short legs of two of said frame elements for cooperating with said securing means for respectively securing the long base of the other frame elements to said short legs.

3. A convertible piece of furniture as defined in claim 1 wherein said hypotenuse leg of each frame element is curved convexly away from the long base.

4. A convertible piece of furniture as defined in claim 1 wherein said frame elements each comprise a one-piece bent tubular member.

5. A convertible piece of furniture including four separate and independent frame elements each of which comprises a one-piece tubular element having a pair of free end portions and bent into the general shape of a right triangle having a long base, a short leg and a hypotenuse, with the ends of the tube being located adjacent each other at the apex between the hypotenuse leg and said long base; means cooperating with the ends of said frame elements for selectively securing the frame elements together in generally aligned pairs located in spaced parallel relation to each other with a) the free ends of the long base of the frame elements in each pair secured to each other or b) with the free ends of the hypotenuse leg of the frame elements in each pair secured to each other; a flexible sling, and means for securing said sling to said pairs of frame elements.

6. A convertible piece of furniture as defined in claim 5 wherein said means for securing the sling to the frame element comprises a hollow tube mounted on the short leg of each of said frame elements and a pair of generally U-shaped connector bars secured to said sling, said connector bars having spaced leg portions respectively adapted to be received in said sleeves.

7. A convertible piece of furniture as defined in claim 6 wherein said means for securing the frame elements together comprises a generally H-shaped connector bar having four legs respectively adapted to be received in the free ends of said tubular elements and in said sleeves.

8. A convertible piece of furniture as defined in claim 7 wherein said hypotenuse leg of each frame element is curved convexly away from the long base.

9. A convertible piece of furniture as defined in claim 8 wherein said sleeves are secured to said short legs on one side of the legs.

10. A convertible piece of furniture as defined in claim 9 wherein said frame elements are formed as two identical pairs wherein the free ends of the hypotenuse legs on one pair are located on the same side of their associated long base as the sleeve on the short leg and the free ends of the hypotenuse legs on the other pair are located on the opposite side of their associated long base from the sleeve on the short leg whereby said H-shaped connector element can secure the free ends of the long base of said one pair of frame elements to the sleeves on said other pair of frame elements and the U-shaped connector bars can be respectively connected to the sleeves of said one pair of frame elements and the free ends of the long bases of the other pair of frame elements thereby to form a lounge chair-type piece of furniture.

11. The convertible piece of furniture as defined in claim 10 including generally cylindrical inserts secured in the free ends of said tubular frame elements and in said sleeves; said inserts having polygonal bores formed therein and the legs of said H and U-shaped bars having similarly shaped polygonal cross sections to fit in said bores.

* * * * *